United States Patent [19]

Greenlee

[11] Patent Number: 4,593,765

[45] Date of Patent: Jun. 10, 1986

[54] TUBING RESETTABLE WELL TOOL

[75] Inventor: Donald R. Greenlee, Cedar Hill, Tex.

[73] Assignee: Dresser Industries, Inc., Dallas, Tex.

[21] Appl. No.: 627,696

[22] Filed: Jul. 3, 1984

[51] Int. Cl.[4] ..... E21B 23/06; E21B 33/129

[52] U.S. Cl. ..... 166/387; 166/123; 166/134; 166/136

[58] Field of Search ..... 166/378, 120, 134, 217, 166/119, 123, 138, 140, 216, 381, 376, 387, 136, 137, 214, 215; 285/3, 4

[56] References Cited

U.S. PATENT DOCUMENTS

| | | | |
|---|---|---|---|
| 2,401,119 | 4/1946 | Taylor, Jr. | 166/2 |
| 2,568,867 | 9/1951 | Otis | 166/214 |
| 2,598,512 | 5/1952 | Cypher | 166/382 |
| 3,047,071 | 7/1962 | Davis | 166/124 |
| 3,207,222 | 9/1965 | Tamplen | 166/123 X |
| 3,298,437 | 1/1967 | Conrad | 166/123 X |
| 3,420,304 | 1/1969 | Kilgore | 166/114 |
| 3,434,538 | 3/1969 | Kilgore et al. | 166/123 |
| 3,548,936 | 12/1970 | Kilgore et al. | 166/216 |
| 3,746,090 | 7/1973 | Read et al. | 166/134 |
| 3,804,164 | 4/1974 | Ellis | 166/120 |
| 3,815,676 | 6/1974 | Read | 166/226 |
| 4,151,876 | 5/1979 | Briggs et al. | 166/134 |
| 4,545,431 | 10/1985 | Fore | 166/123 X |

OTHER PUBLICATIONS

"Composite Catalog of Oil Field Equipment and Services"—1980–1981, published by World Oil; pp. 700, 900 and 901.

*Primary Examiner*—Stephen J. Novosad
*Assistant Examiner*—David J. Bagnell

[57] ABSTRACT

A tubing string resettable bridge plug is conditioned for initial wireline installation in a well utilizing an adapter within a mandrel carrying the slip assembly of the bridge plug and frangible connecting means between the sealing assembly and mandrel to place the sealing assembly in an alternate transport condition for first being set by means of a wireline device. Thereafter, the tubing string may be connected to the bridge plug downhole to release the bridge plug for resetting in a different position.

21 Claims, 28 Drawing Figures

TUBING RESETTABLE WELL TOOL

TECHNICAL FIELD

This invention relates to a well tool and particularly, a well tool which may be set downhole, released and moved to a new position, and reset without having to pull the tubing string to redress the tool.

BACKGROUND ART

In one example of a prior art well tool, a bridge plug carried on the end of the tubing string may be anchored to the casing of the well in a selected downhole position to isolate the zone in the well below the tool from the zone above the tool for the performance of a well service operation, such as acidizing, formation fracturing or pressure containment. Because a particular well may require that such operations be carried out at different locations within the well, it is desirable that the tool have the ability to be moved from location to location without having to pull the tubing string from the well to redress the tool. In one form of bridge plug currently available, a tubular mandrel is connected to the lower end of the tubing string and mounted on the mandrel is a slip assembly and sealing unit. Connected to the slip assembly is an anchor cage or reaction member which typically engages the inside surface of the casing so that relative motion between the slip assembly and the mandrel may be obtained by manipulation of tubing string. Typically, the manipulation of the tubing string includes both rotational movement in clockwise and counterclockwise directions as well as movement axially relative to the casing in either direction within the well. Combinations of rotational or axial movement may be utilized in the tool to cause slips in the slip assembly to be set against the well casing to anchor the tool in a selected position, and also to release the tool from that position for subsequent resetting at another location.

In another type of well tool, the wireline retrievable bridge plug, the tool may be lowered into position in the well on a wireline and set, such as by means of a wireline setting gun. The wireline tool, however, lacks the ability to be released and reset within the well without having to be pulled from the well for redressing purposes. However, advantages do exist in that lighter duty equipment may be used at the well head for conducting wireline operations as opposed to heavy duty workover rigs or production rigs that are necessary to provide support for the heavier well tubing.

DISCLOSURE OF THE INVENTION

The primary aim of the present invention is to provide an improved well tool which may be set in a well by means of a wireline setting device, and which thereafter, may be released and reset at another location within the well without having to retrieve the tool from the well for redressing purposes. More specifically, the present invention contemplates the provision of a unique adapter along with locator means to releasably support the slip assembly of the tool in an alternate position for transporting the tool downhole by wireline and enabling the tool to be set by actuation of a wireline setting device. Thereafter, with the wireline device removed from the tool, production tubing or the like may be connected to the tool downhole and the tool released and reset in another position for additional well servicing.

The invention also resides in the unique construction of the adapter, and the means for supporting the slip assembly in the alternate transport.

These and other advantages and features of the present invention will become more apparent from the following drawings when taken in conjunction with the best mode of carrying out the invention.

BEST MODE OF CARRYING OUT THE INVENTION

Figure 3A:
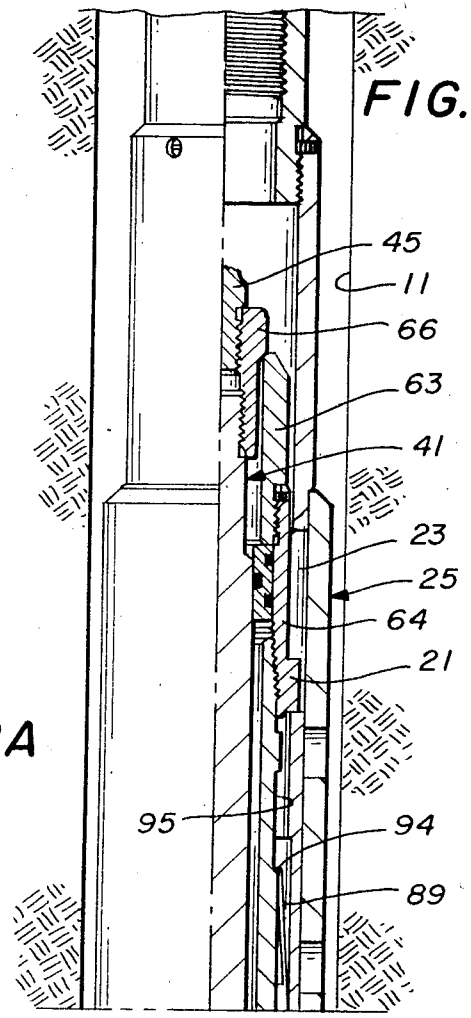
FIGS. 3A through 3F collectively represent a combined cross-sectional and elevational view of the tool in condition for movement vertically within the well for resetting by manipulation of a tubing string carrying the tool.
Figure 2A:
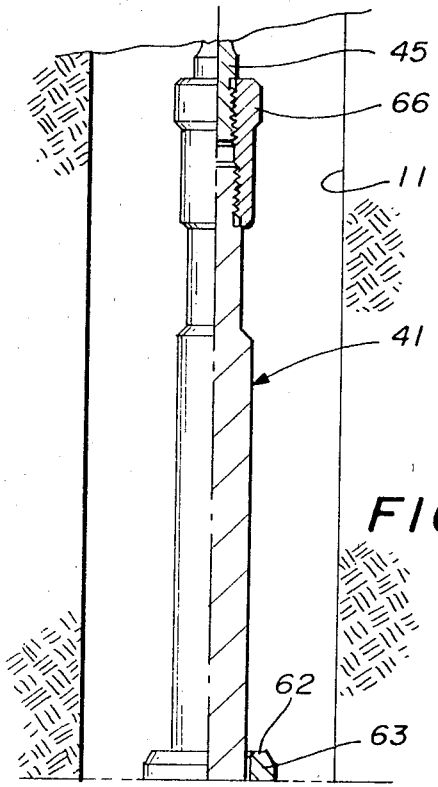
FIGS. 2A through 2F collectively represent a combined cross-sectional and elevational view of the tool installed in a well.
Figure 1A:
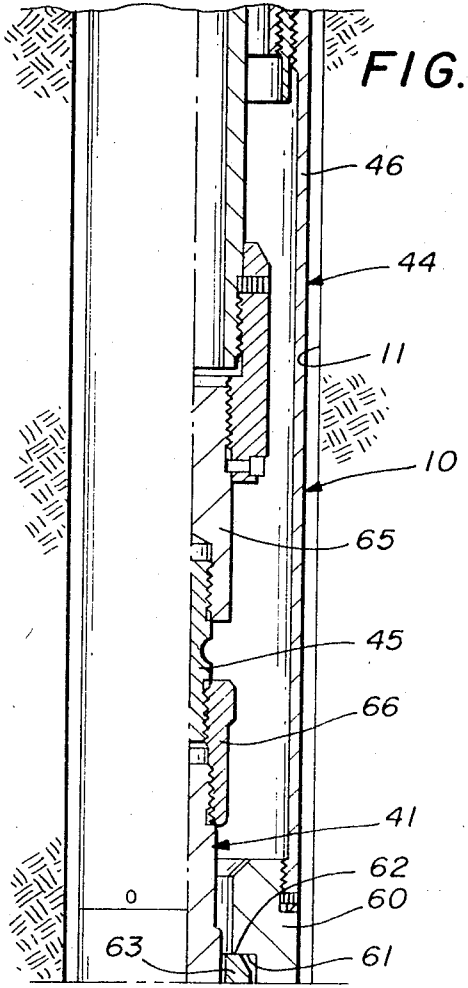
FIGS. 1A through 1F collectively represent a combined cross-sectional and elevational view of a well tool embodying the novel features of the present invention as the tool would be run into a well.
Figure 3B:
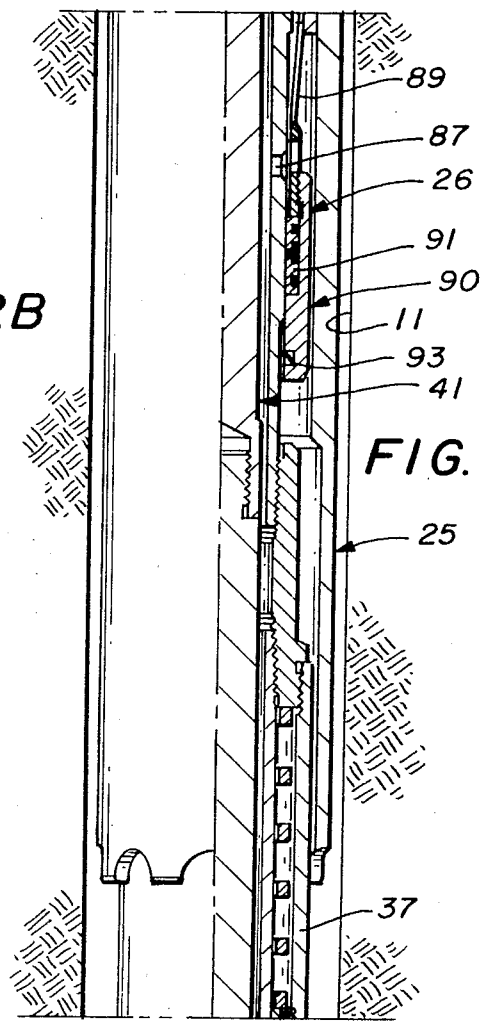
Figure 2B:
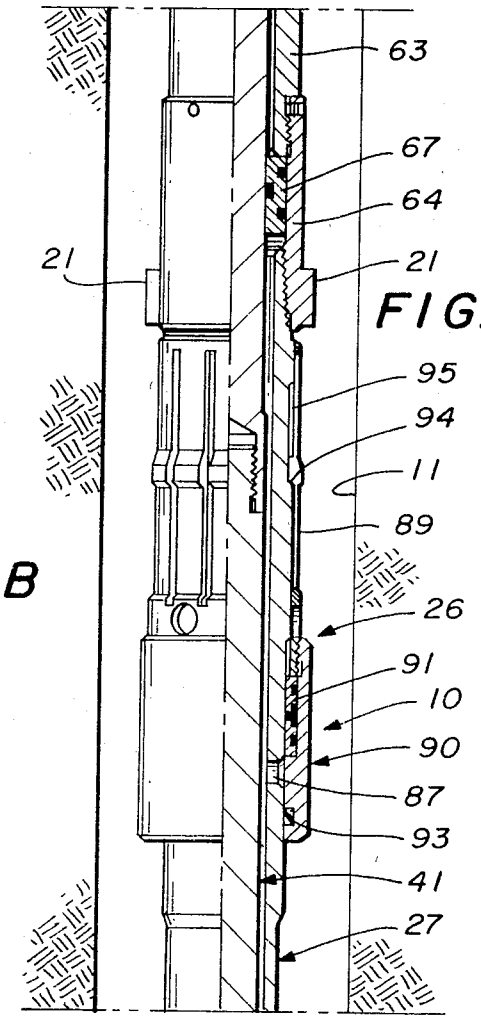
Figure 1B:
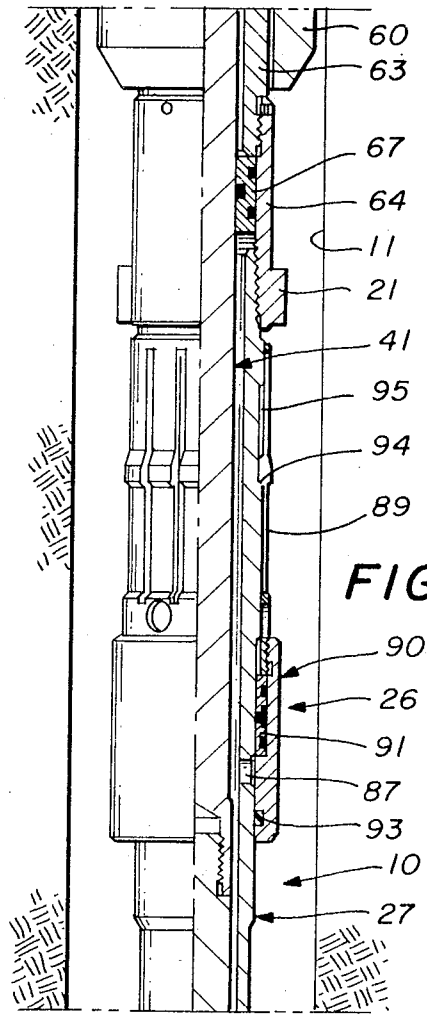
Figure 2C:
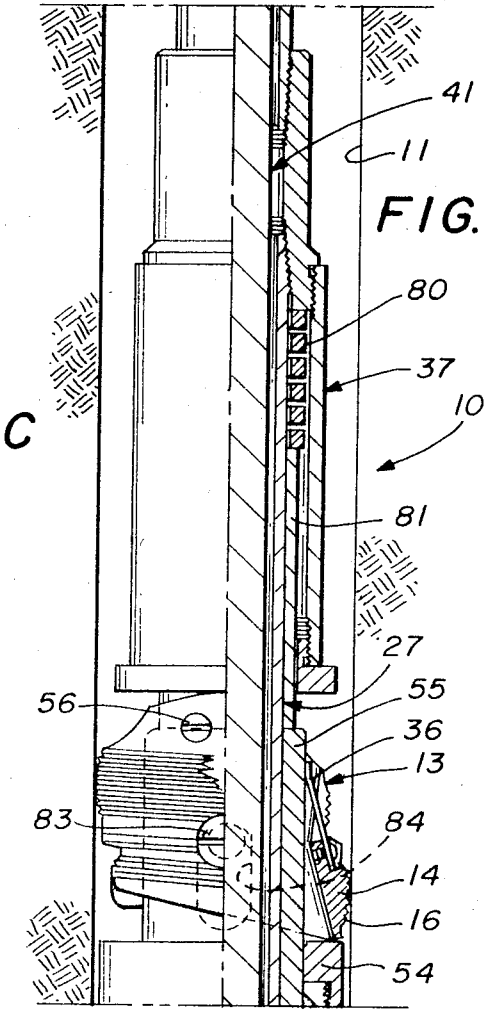
Figure 1C:
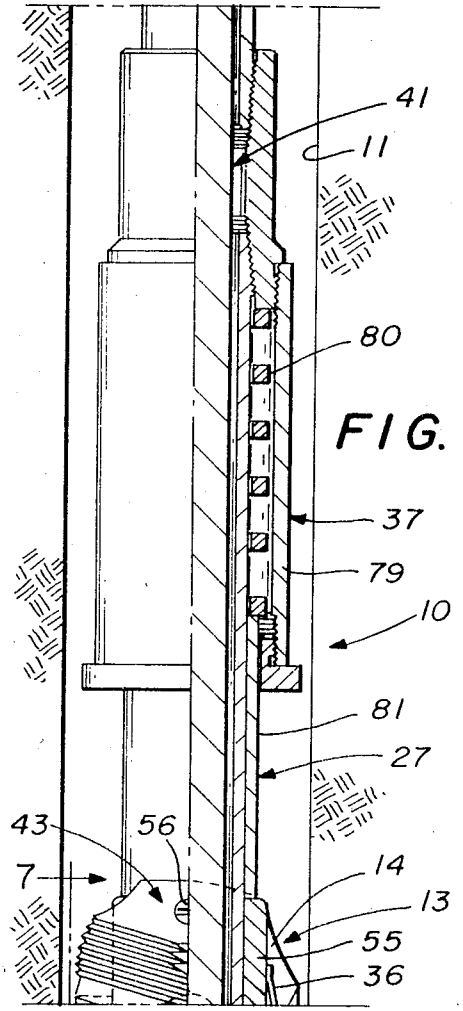
Figure 3D:
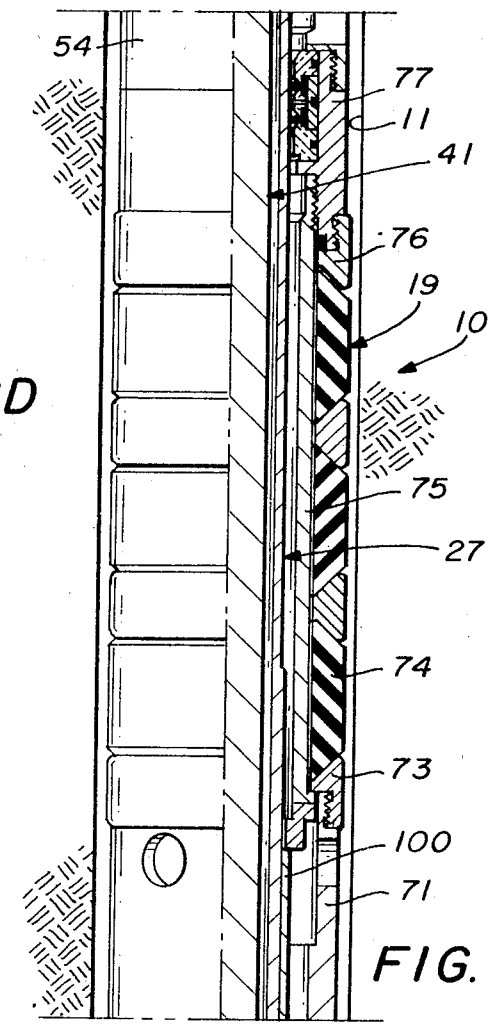
Figure 2D:
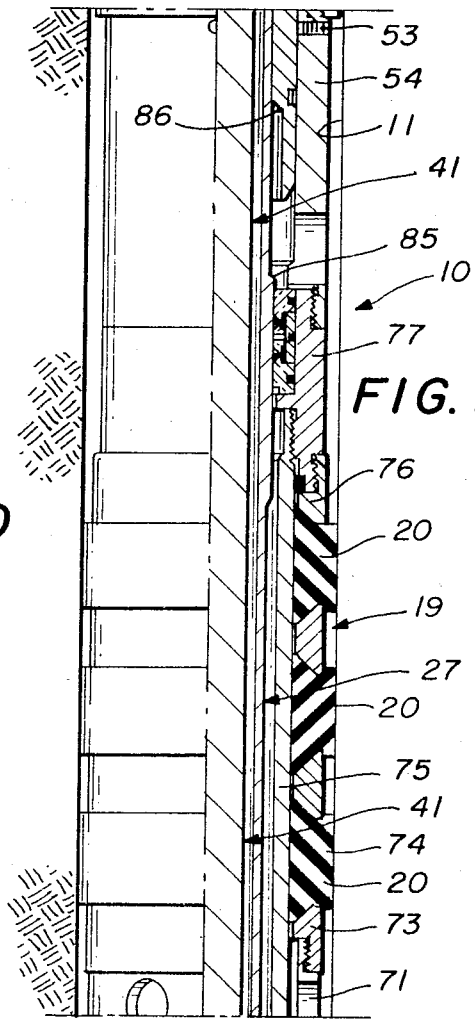
Figure 1D:
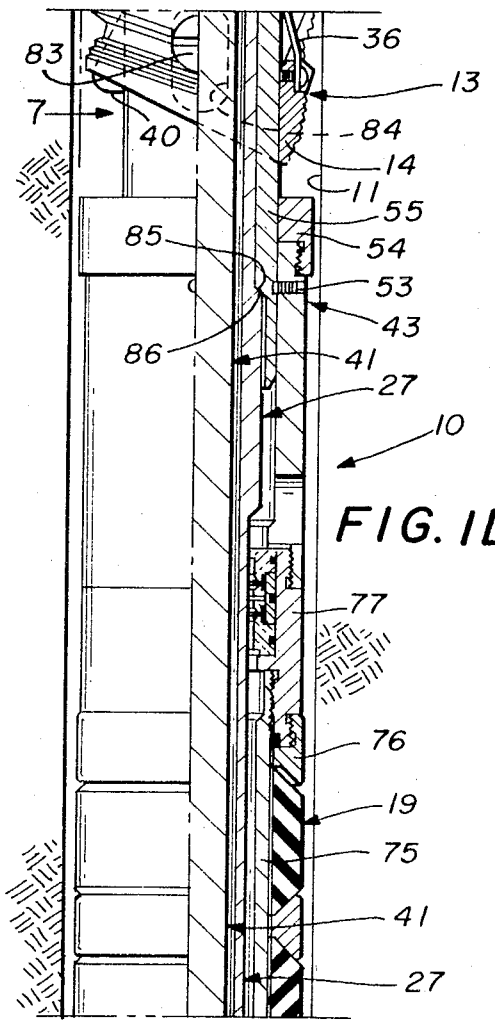
Figure 3E:
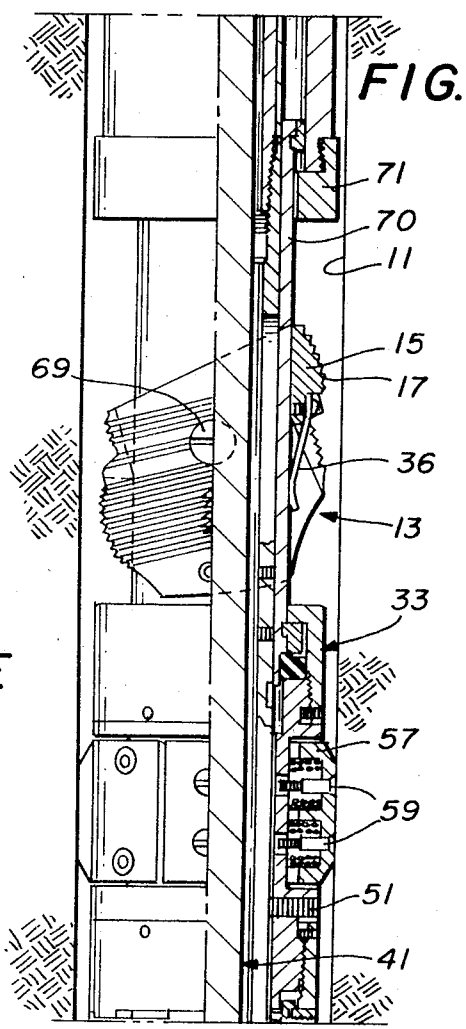
Figure 2E:
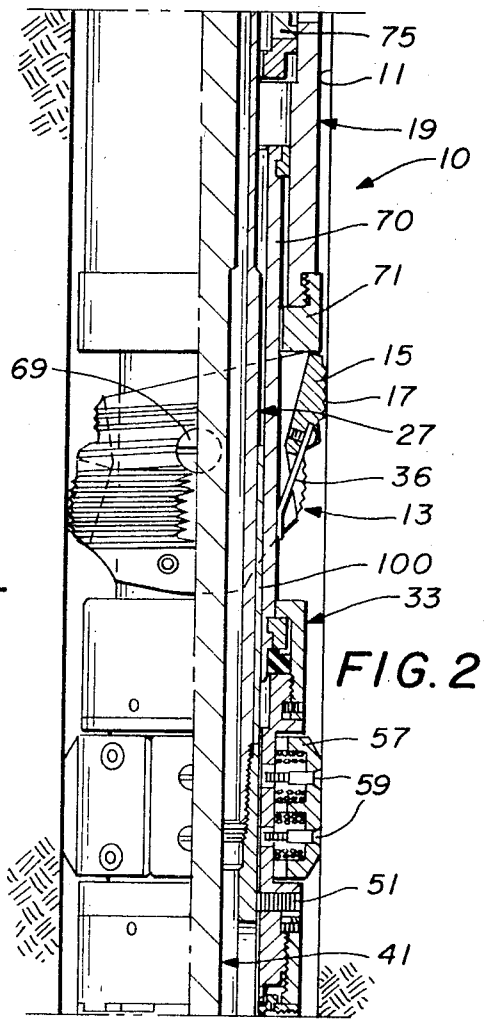
Figure 3F:
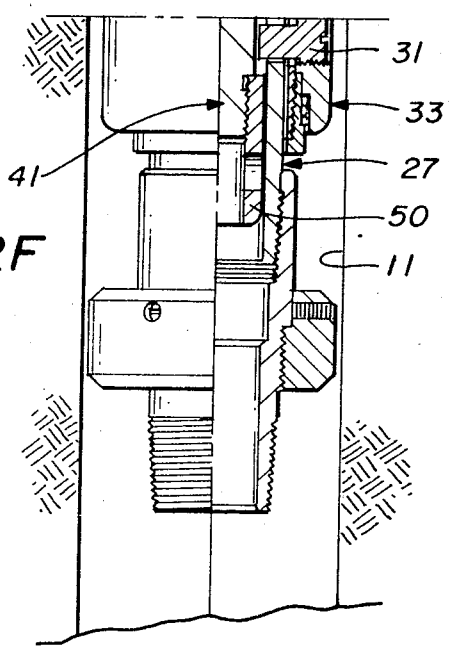
Figure 2F:
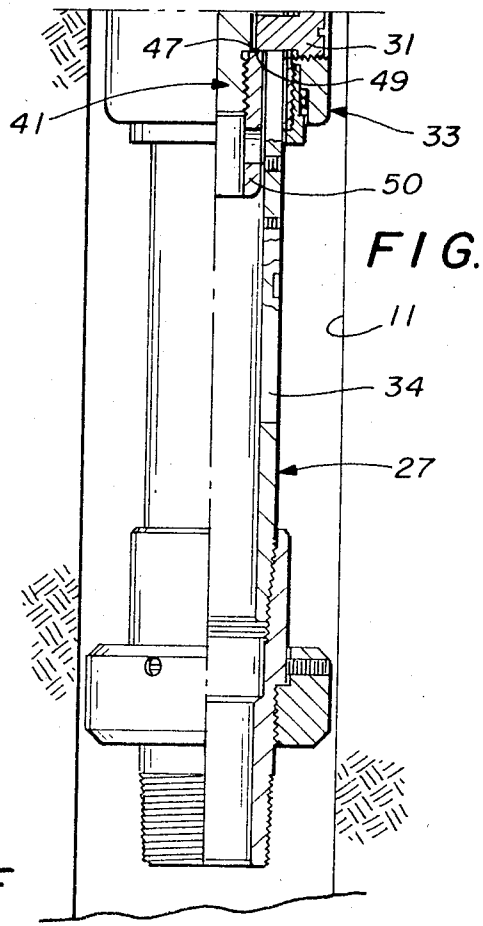

As shown in the drawings for purposes of illustration, the present invention is embodied in a retrievable bridge plug 10 such as may be used at various selected downhole positions in a well to isolate the zone of the well below the plug from the zone above it. In the combined FIGS. 2A through 2F, the bridge plug is shown as being anchored to the inside surface of casing 11 in the well by means of a bi-directional slip assembly 13, which includes a pair of upper and lower slip elements 14 and 15. As shown particularly in FIG. 2C, the upper slip element 14 is provided with an outer surface having teeth 16 formed therein to bite into the inside surface of the well casing and thereby anchor the tool 10 against being pulled upwardly within the well. Similarly, the lower slip element 15 (FIG. 2E) includes an outer surface with teeth 17 formed therein to bite into the surface of the casing, but to hold the tool against being pushed downwardly within the well. Compressed between the upper and lower slip elements 14 and 15 is a sealing unit 19 (FIG. 2D) including elastomeric seals 20 pressed against the surface of the casing to seal the annular area between the tool and the casing. At the upper end of the tool, coupling pins 21 extend radially outward to nest within a trap 23 of a connecting recess 24 in an on-off tool 25 (see FIGS. 3A, B, 8 and 9 carried on the end of a tubing string (not shown). Immediately beneath the coupling pins 21, is an equalizer valve 26 adapted to be shifted between open and closed positions to equalize the fluid pressure on either side of the sealing unit 19 preparatory to manipulation of the tubing string to unset, move, and reset the bridge plug in another position in the well.

Figure 6:
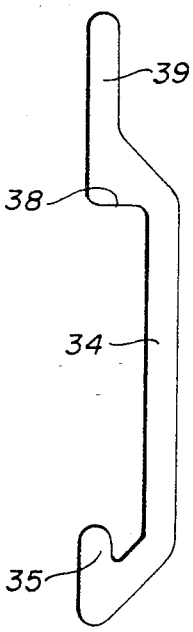

A general understanding of the tubing string manipulations involved in moving the tool 10 into position, setting the slip assembly 13 to anchor the tool in place, and releasing of the slip assembly for moving the tool to a different selected position in the well, may be obtained from the schematic illustrations shown in FIGS. 4A through 4E. First with reference to FIG. 4A, the tool 10 is shown schematically as including a mandrel 27 to be carried on the end of the tubing string and extending through each of the upper and lower slip elements 14 and 15 of the bi-directional slip assembly 13. Resilient means 29 such as would include the sealing unit 19 of the exemplary bridge plug is functionally disposed between the slip elements and on the mandrel for urging the slip elements in a setting or extended direction once set against the well casing. Beneath the lower slip element 15 and connected to the mandrel 27 by way of connecting means 30 including a gudgeon pin 31 is a reaction member 33. For operational purposes, the radially outward end of the gudgeon pin is secured to the reaction member while opposite or inner end is free to ride within a J-slot 34 formed within the mandrel. In a transport condition for the tool as carried on the lower end of a tubing string, the reaction member 33 is disposed in a lower position relative to the mandrel 27 with the gudgeon pin 31 captured within a lower trap 35 of the J-slot 34 (see FIGS. 4A and 6). In this condition, the resilient means 29 is relatively uncompressed and the upper and lower slip elements 14 and 15 are urged into retracted positions away from engagement with the well casing 11 by means of release urging springs 36.

Once the tool 10 is located at a desired position in the well, setting of the slips 14 and 15 is accomplished by first pulling up on the tubing string and then rotating in the tubing string in a clockwise direction to shift the gudgeon pin 31 out of the lower trap 35 of the J-slot 34. Frictional engagement of the reaction member 33 with the inside wall of the casing 11 holds the gudgeon pin 31 in a relatively fixed position within the well so as to provide for the relative rotational movement between the J-slot 34 and the gudgeon pin when the tubing string is rotated. Once the gudgeon pin has been located out of the lower trap 35, the mandrel 27 may be shifted downwardly relative to the reaction member 33 by setting down on the tubing string. This action causes resilient means 29 to engage the lower slip element 15 (see FIG. 4B) and to cock it outwardly into an extended position for griping the inside surface of the casing 11 thereby setting the lower slip. At the same time, setting stop means 37 on the mandrel 27 above the upper slip 14 is shifted downwardly with the mandrel and engages the upper slip causing it also to cock outwardly into an extended position and set against the inside surface of the casing as is shown also in FIG. 4B. To complete setting of the slips and effectively compress the resilient means 29 between the slip elements 14 and 15, the tubing string thereafter is rotated in a counterclockwise direction to locate the gudgeon pin 31 in an upper trap 39 of the J-slot 34 and the tubing string is then lifted, pulling the mandrel upwardly until a shoulder 38 in the J-slot abuts the pin 31. Because the upper slip element 14 holds against movement in an upward direction and the lower slip holds against movement in a downward direction, upward movement of the tubing string causes the lower slip element to be lifted while the upper slip remains fixed in the casing so as to further compress the resilient means 29 between the two slip elements 14 and 15 to the extent desired to insure that the slip elements will remain effectively anchored in the casing. (See FIG. 4C).

Figure 4E:
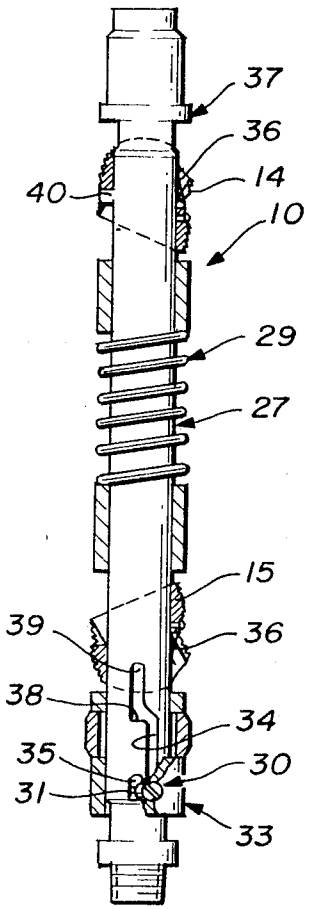
FIGS. 4A through 4E are schematic illustrations of the basic operating principles of the prior art tool, showing the tool being lowered into a well, being set and being released for resetting in another location.
Figure 4D:
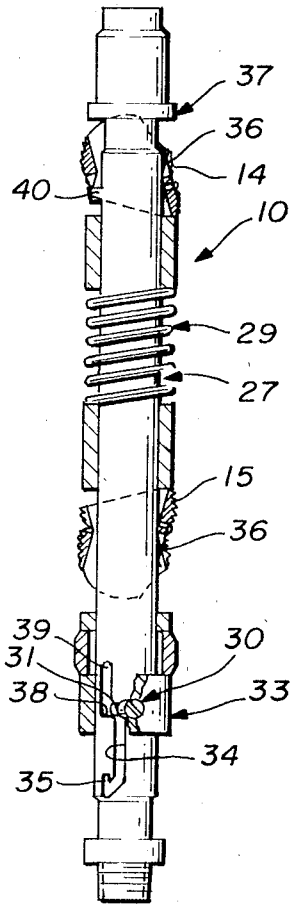
Figure 4C:
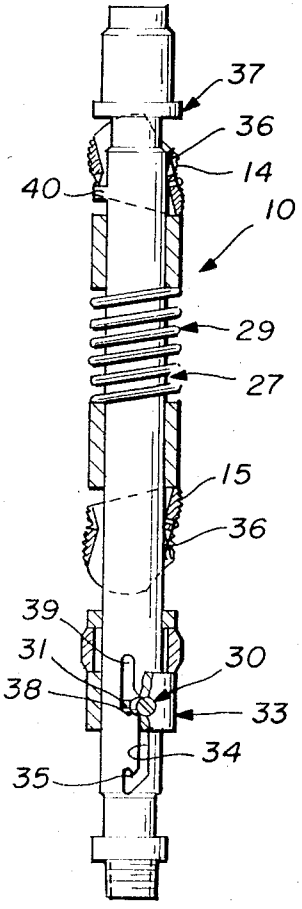
Figure 4B:
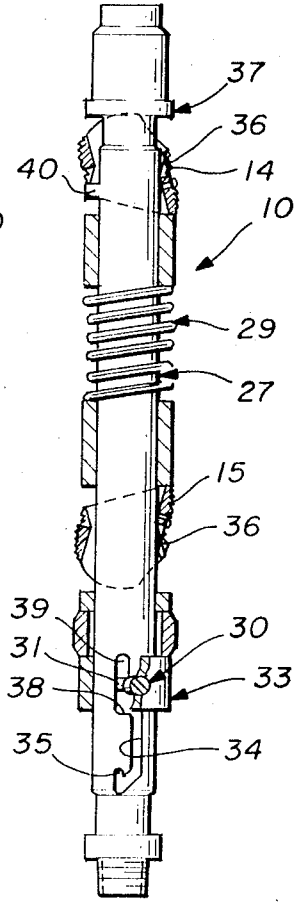
Figure 4A:
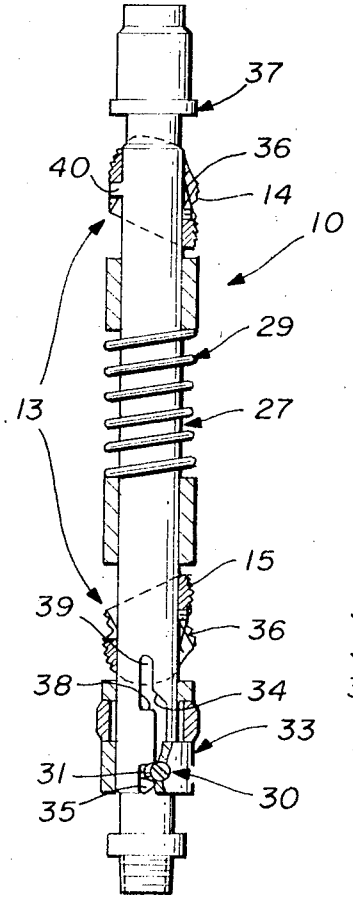

To release the slip assembly 13 from the set position, the mandrel 27 is lowered slightly shifting the pin 31 off the shoulder 38 while also applying torque in a clockwise direction to the tubing string. This will shift the gudgeon pin 31 to the release side of the upper trap 39 (see FIG. 4D) so that when the tubing string thereafter is pulled upwardly while maintaining the torque, the mandrel travels upwardly with the gudgeon pin riding within the J-slot into the lower trap 35. As shown in FIG. 4E, as the mandrel is lifted by pulling on the tubing string, slip disengaging means 40 in the form of a retrieving lug lifts the upper slip element 14 into its retracted position, releasing the compressive restraint on the resilient means 29 to allow such means to expand. With sufficient upward movement for expansion of the resilient means and as the gudgeon pin 31 bottoms out in the lower trap 35, the lower slip element 15 is urged into a release position by action of the release urging means 36 thereby completing the unsetting of the slip elements to free the tool 10 for resetting in another position in the well.

When first installing the exemplary bridge plug 10 in a well within which servicing is to be performed at a later date, it is preferable that the tool be installed as quickly and inexpensively as possible. The present invention contemplates a unique method and apparatus to achieve this end for initial installation of the well tool by elimination of the need for using a tubing string in the initial installation, yet while leaving the bridge plug in the well for later connection to a tubing string so that the tool may be repositioned within the well without the need of the tool being pulled out of the well for redressing purposes. Herein, this is accomplished through the provision of a unique adaptor 41 (see FIGS. 1 and 5) and fastening means 43 for securing the slip assembly 13 including the connecting means 30 in an alternate transport condition so that the adaptor may be connected to a wireline setting device 44 that may be actuated to set the slip elements 14 and 15 downhole from a remote position at the well head. Advantageously then, the bridge plug may be intalled quickly and inexpensively using lighter wireline equipment so that heavier duty workover or production rigs may be brought in at a later time and connected with the bridge plug downhole to perform the well preparation or servicing operations.

In the present instance, the adaptor 41 comprises an elongated plug telescoped through the equalizer valve 26 and mandrel 27 and extending downwardly past the lower slip element 15 to an area within the mandrel adjacent the reaction member 33 (see FIGS. 1A through 1F). At the upper end of the plug a shear stud connector 45 frangibly secures the adaptor to the wireline setting device 44. Such devices are well known in the art and are operated by means of an explosive charge (not shown) which is set off within a chamber in the device causing, the simultaneous application of a force from the housing 46 of the device to the top of the tool in the downward direction and an upward pulling force across the shear stud connector into the adaptor plug 41. In the present arrangement, when the device is actuated, the adaptor plug 41 is pulled upwardly with the upper and lower slip elements 14 and 15 being shifted from their retracted positions into their extended positions to anchor against the well casing and with the sealing unit 19 at the same time being compressed to seal against the inside surface of the well casing. As the setting forces become sufficiently high, the shear stud connector 45 breaks to complete the setting procedure and free the wireline setting device from the bridge plug for retrieval to the head of the well.

At the end of the adaptor 41 opposite the shear stud connector 45, first and second shoulders 47 and 49 on the adaptor and reaction member 33, respectively, provide for the transmission of an upwardly directed force through the adaptor to the reaction member and lower slip element 14 causing the latter to engage the lower end of the sealing unit 19 to compress the seals 20 from one direction. This setting force is reacted against from the other direction by the lower end of the wireline setting device 44 which pushes the mandrel 27 downwardly along with the setting stop means 37. Thus, the seals in the sealing unit are compressed simultaneously by both slip elements 14 and 15 as the latter are set against the inside surface of the well casing.

Specifically transmitting forces at the lower end of the adapter plug 41, the first shoulder 47 is defined as the upper end of a tubular end cap 50 of the adaptor plug 41 and the second shoulder 49 is defined as the lower side of an extension of the gudgeon pin 31 as it protrudes through the J-slot 34 in the mandrel 27. As particularly shown in FIGS. 1C through 1F, the fastener means 43 provide for releasably supporting the slip assembly 13 and the sealing unit 19 relative to each other in an initial or alternate travel position. Herein, such means includes a lower shear screw 51 extending between the reaction member 33 and the mandrel 27 and a frangible screw 53 extending between a housing 54 of the sealing unit 19 and a tubular carrier 55 to which the upper slip 14 is pinned. Additionally, included is an upper shear screw 56 which secures the upper slip element 14 releasably on the slip carrier in the retracted position. Each of the screws 51, 53 and 56 are sheared as an incident to the initial setting of the slip assembly utilizing the wireline setting device 44, and once sheared, the bridge plug is conditioned to thereafter function as a tubing retrievable bridge plug.

Figure 1E:
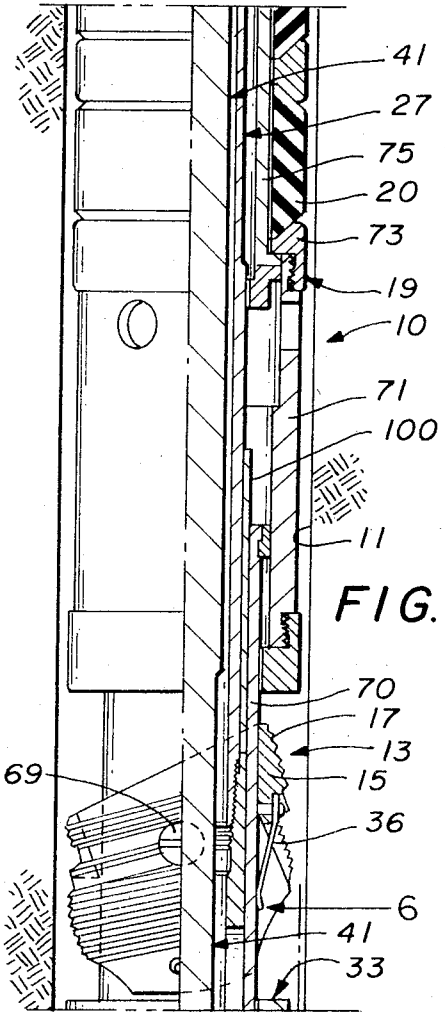
Figure 1F:
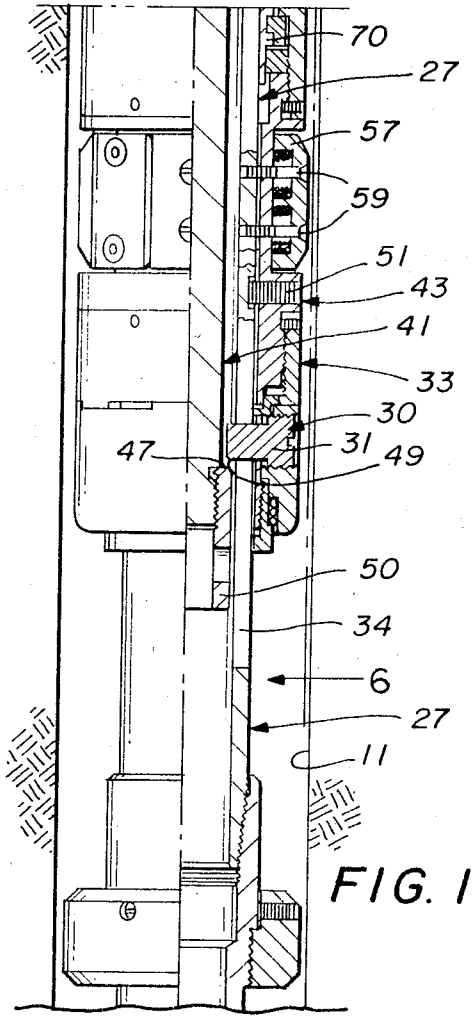

To additionally condition the bridge plug 10 for being lowered into the well on a wireline, friction elements 57 in the reaction member 33 are secured in retracted positions spaced away from in engagement with the well casing by means of frangible pins 59 as shown in FIG. 1F. As with the other shear screws 51, 53 and 56, these shear pins 59 also are broken as an incident to setting the slip assembly by means of the wireline setting device.

Figure 5:
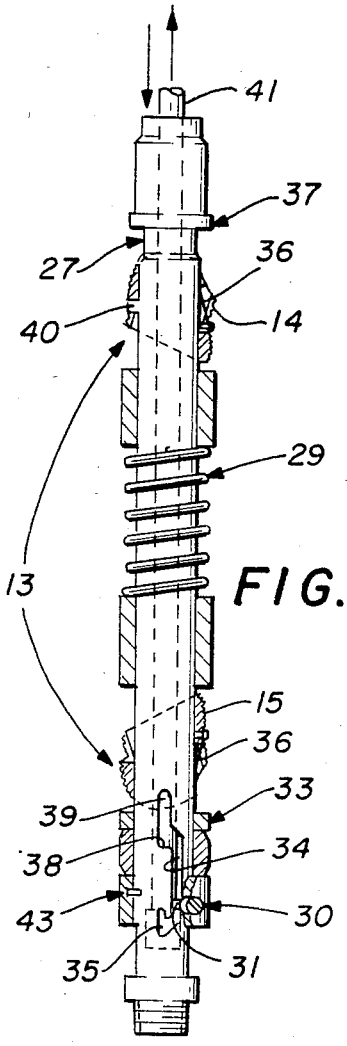
FIG. 5 is a schematic illustration illustrating the novel improvements made in the prior tool to incorporate the present invention.

As shown schematically in FIG. 5, the exemplary well tool includes the basic functional structure of the adaptor 41, the connecting means 30, and the fastener means 43 so that upon actuation of the wireline setting device 44, the adaptor is pulled upwardly and acts through the connecting means to lift the reaction member 33 thereby shearing the fastener means 43 and simultaneously lifting the lower slip 15 of the bi-directional slip assembly 13 upwardly. At the same time, a force in the other direction acts downwardly on the setting stop means 37 shifting the upper slip 14 of the bi-directional slip assembly downwardly so as to compress the resilient means 29 between the two slip assemblies. Once the tool is anchored in the well in the foregoing fashion and the wireline mechanism has been retrieved from the well, the condition of the tool is substantially identical to that as is shown schematically in FIG. 4C.

With reference to FIGS. 1A through 1F and to more specifically describe the structure and novel method of the installation of the exemplary well tool 10, the wireline setting device 44 is connected in a tubing string (not shown) with the lower end portion of the device secured to the bridge plug 10 by means of the shear stud connector 45 and with the upper end (not shown) thereof threaded into the lower end of the well tubing in the string. An end collar 60 in the lower end portion of the tubular housing 46 of the wireline setting device includes a radial shoulder 61 abutting an upper end shoulder 62 of a tubular stem 63 which connects through a coupling 64 with the mandrel 27. With this arrangement, force may be transmitted through the shoulders 61 and 62 downwardly through the mandrel. From within the wireline setting device 44, the upper end of the shear stud is threadably connected to a plunger 65 and the lower end is connected to the adaptor plug 41 by means of a tubular collar 66. Herein, the adaptor plug is a solid rod sealed within the mandrel 27 of the tool by means of a sealing ring unit 67 located within the coupling 64 at the upper end of the tool. At the lower end of the plug, the stem cap 50 (FIG. 1F) includes the first shoulder 47 for abutting engagement with the second shoulder 49 of the gudgeon pin 31 which in turn is secured within the reaction member 33. Accordingly, as the wireline setting pluger 65 is pulled upwardly, force is transmitted through the shear stud 45 to the adaptor plug 41 and the stem cap 47 to the gudgeon pin and, in turn, to the reaction member 33 with the latter sliding upwardly on the mandrel and the gudgeon pin following within the J-slot 34.

In the exemplary tool, the lower slip element 15 is located within a fixed position relative to the reaction member 33, being mounted by a pin 69 (FIG. 1E) on a tubular sleeve 70 whose lower end is secured within the upper end of the reaction member. The lower slip element, thus rides with the reaction member upwardly on the mandrel 27 as the adaptor plug 41 is lifted by actuation of the wireline setting device. As the lower slip element and reaction member are lifted upwardly, the upper end of the sleeve 70 slides upwardly within a lower head 71 of the sealing unit 19 until the slip element contacts the head overcoming the release spring 36 and causing the element to pivot about the pin 69 to shift into an extended position with the teeth of the element embedding within the interior surface of the well casing. As may be seen in FIGS. 1D and 1E, the lower head 71 includes an annular thimble 73 abutting the lower sealing element 20 of the sealing unit. The thimble is mounted to slide upwardly on a support shell 75 so as to compress the seal elements between the lower thimble and an upper thimble 76 of an upper head 77 of the sealing unit.

To provide a compressive force against the sealing unit 19 from the other direction and to simultaneously set the upper slip element 14, the exemplary tool includes the setting stop means 37 in the form of a slip control housing 79 containing a take up spring 80 mounted above the upper slip element. The control housing is fixed to the mandrel 27 with the spring 80 being telescoped into the annular space between the mandrel and the housing above the upper slip element.

Extending downwardly out of the housing is a spacer sleeve 81 mounted on the outside of the mandrel with the upper end of the spacer sleeve engaged by the spring 80 and the lower end of the sleeve abutting the tubular slip carrier 55. Herein, the upper slip element is connected to the carrier 55 by means of a pin 83 extending into an elongated slot 84. As previously described, the shear screw 56 secures the upper slip element to the carrier holding the slip initially in a retracted position. Abutting annular shoulders 85 and 86 on the mandrel and carrier (FIG. 1D), respectively, serve to limit downward movement of the spacer sleeve and carrier relative to the mandrel. With this structure, it will be appreciated that the upper slip element 14 is located on the mandrel, being resiliently urged into a lowermost position by the spring 80 acting through the spacer sleeve 81, carrier 55 and shoulders 85 and 86. Accordingly, as the sealing unit 19 is urged upwardly by action of the lower slip element against the lower head of the sealing unit, the upper head will abut the upper slip element overcoming the release spring 36 and causing the slip element 14 to pivot outwardly into its extended position for engagement with the interior surface of the well casing. The spring 80 and housing 79 of the setting stop means 37 thus serve to resiliently position the upper slip element for pivoting into its extended position and setting of the slip assembly. Moreover, it will be appreciated that the takeup spring 80 and the resiliency of sealing unit 19 functional, serve together as a spring compression assembly to urge the slip elements into their extended positions when compressed so as to keep the slips set against the well casing.

After the bridge plug 10 is set within the well, the wireline setting device 44 may be removed from the well leaving the plug behind. This exposes the upper end of the bridge plug including the annular coupling 64 and its coupling pins 21 for connection to the on/off tool 25 of a tubing string which may be manipulated to release the bridge plug and move it to a different location within the well. As shown in FIGS. 3A through 3F, release of the bridge plug 10 from a set position such as that shown in FIGS. 2A through 2F is achieved by lowering the tubing string with the on/off tool connected to the end thereof to the bridge plug and manipulating the tubing string to latch the on/off tool to the coupling pins 21. When secured, the bridge plug may be released by simply applying torque in a counterclockwise direction to the tubing string and lifting upwardly.

Figure 3C:
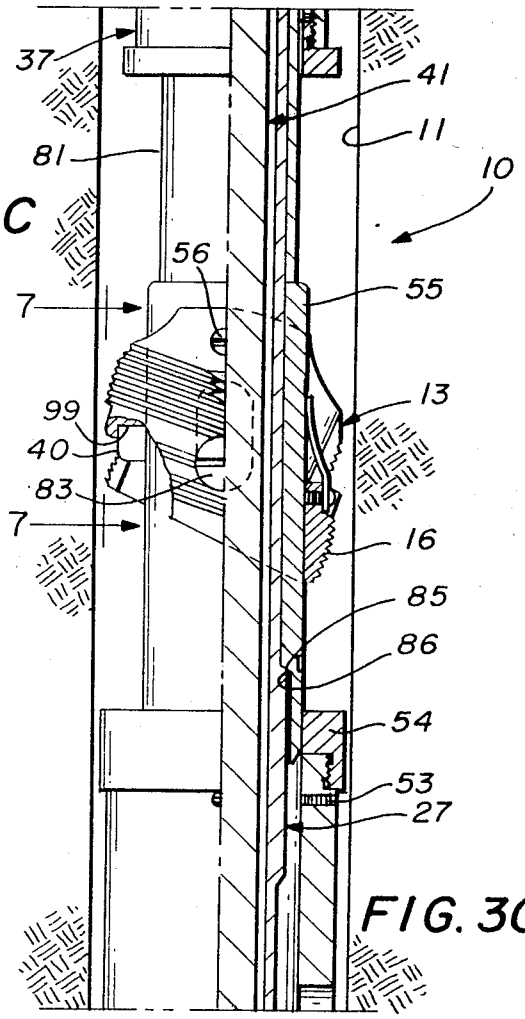
Figure 8:
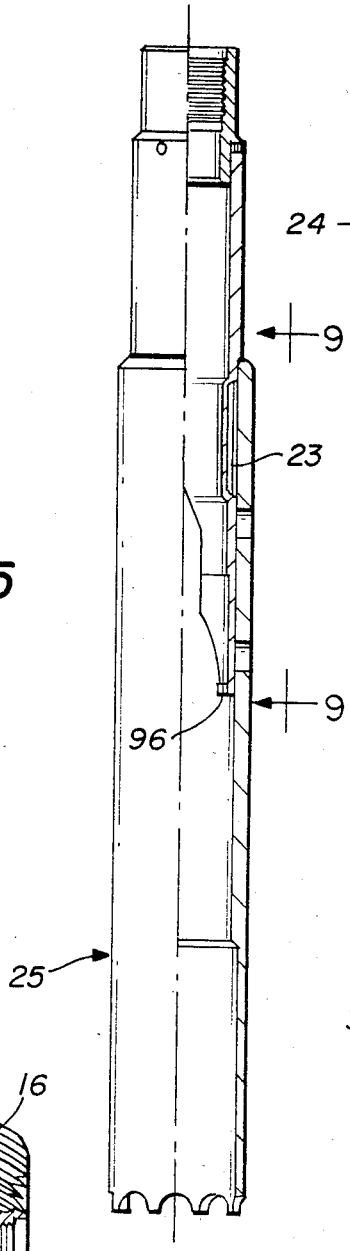
FIG. 8 is an enlarged combined elevational and cross sectional view of an off-on tool used in conjunction with the tool embodying the present invention.
Figure 9:
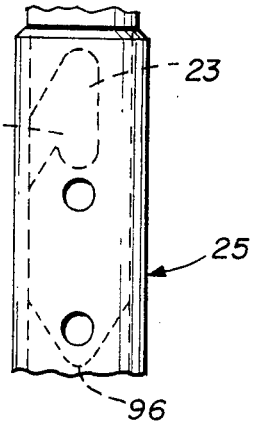
FIG. 9 is a view taken substantially along line 9—9 of FIG. 8.
Figure 7:
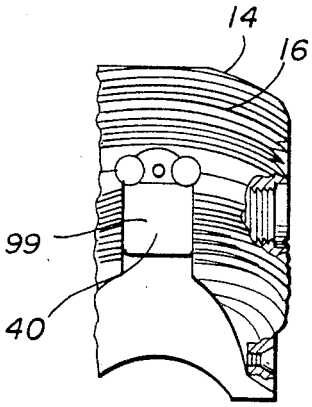
FIGS. 6 and 7 are enlarged fragmentary elevational views taken along the lines 6—6 and 7—7 from FIGS. 1E and F, and 3C respectively, with various parts of the tool being removed for clarity of illustration.

Upon initial connection of the on/off tool 25 to the upper end of the bridge plug 10, the equalizer valve 26 is shifted into an open position, exposing a port 87 (FIG. 3B) normally closed by the valve. Opening of the port establishes fluid communication across the sealing unit 19 between the zones above and below the plug 10 enabling easier releasing of the plug. As shown more particularly in FIGS. 2A and 2B, the equalizer valve 26 comprises a closedfinger collet sleeve 89 telescoped onto the mandrel 27 beneath the coupling 64. A sealing collar 90 is attached to the lower end of the collet and includes axially spaced O-ring seal members 91 and 93 positioned to seal across the port 87 with the spring fingers of the collet resiliently latching against an upper shoulder 94 of an annular recess 95 also formed in the mandrel 27 to hold the sealing collar in place. As the on/off tool 25 is telescoped onto the coupling, a lower shoulder 96 (see FIGS. 8 and 9) abuts the top of the sealing collar of the equalizer valve and shifts the sealing unit downwardly past the port 87 thereby opening the valve (see also FIGS. 3A and 3B). With pressure equalized across the sealing unit 19 of the bridge plug, the tubing string may be lifted while applying torque in a counterclockwise direction to seat the coupling pins 21 in the trap 23 of the on/off tool 25 and to also align the lower gudgeon pin 31 within the J-slot 34 of the mandrel off the shoulder 38 so that as the tubing string is pulled upwardly, the mandrel also is lifted upwardly without further compression of the sealing unit 19. Accordingly, upward movement of the mandrel relaxes compression on the spring 80 in the stop means 37 and with sufficient movement, the retrieving lug 40 on the mandrel 27 engages a retrieving shoulder 99 (see FIG. 7) in the upper slip element 14, thereby causing the upper slip to pivot from its extended position into its retracted position. As is shown in FIG. 3C, this action also causes the mandrel shoulder 85 to lift the upper slip carrier 55 upwardly, shifting the pin 83 within the slot 84 from an uppermost position to a lowermost position. As the mandrel is pulled further upwardly, the upper end of a pick up sleeve 100 (FIG. 3D), on the mandrel engages the bottom of the seal assembly above the lower slip element 15. Coincident therewith, the gudgeon pin 31 will bottom out within the J-slot 34 so that the reaction member 33 and lower slip element 15 acting through the slip pin 69 and support sleeve 70 thereby lift the lower slip element so the slip release spring 36 urges the lower slip into its retracted position. Thus, by means of a straight pull action on the tubing string, the bridge plug may be released from an anchored position within well. Thereafter, the bridge plug may be repositioned within the well and reset in the manner previously described by tubing string manipulation.

In view of the foregoing, it will be appreciated that the present invention brings to the art a new and improved well tool shown in the form of the exemplary bridge plug 10 which may be set initially in a well by use of a wireline setting device 44 when first installing the bridge plug in the well. Thereafter, with the wireline setting device moved, the tubing string of a workover or production rig may be attached to the bridge plug for releasing the bridge plug by manipulation of the tubing string and relocating the plug as may be desired within the well without also having to retrieve the bridge plug for redressing the tool. Advantageously, the foregoing has been achieved through the use of the unique adaptor plug 41 and frangible connecting means for placing the slip assembly of the bridge plug in an alternate transport condition enabling the slip assembly to be set by means of the wireline setting device.

The embodiments of the invention in which an exclusive property of privilege is claimed are defined as follows:

1. In a tool including means for connecting said tool to a tubing string for manipulation of the tubing string to set, unset and reset a slip assembly of the tool against the casing in a well without the necessity of pulling the tubing string from the well, the improvement comprising an adapter with one end frangibly connectable to a wireline setting device and an opposite end operably connected to said slip assembly for a first setting of the slip assembly with the wireline device.

2. In a tool including means for connecting said tool to a tubing string for manipulation of the tubing string to shift a slip assembly between setting and transport conditions relative to resilient means for setting, unsetting and resetting of the slip assembly against the casing in a well without the necessity of pulling the tubing string from the well, the improvement comprising an adapter with one end frangibly connectable to a wireline setting device and an opposite end operably connected to said slip assembly for a first setting of the slip assembly with the wireline setting device, the slip assembly being releasably supported in an alternate transport condition relative to said resilient means for said first setting of the slip assembly.

3. In the tool as set forth in claim 2, wherein the improvement further comprises means for releasably supporting the slip assembly in said alternate transport condition to be released therefrom as an incident to said first setting of the slip assembly.

4. In the tool as set forth in claim 3 with the slip assembly including a reaction member with a friction element engageable with the well casing for reaction forces to be transmitted between the tool and the tubing string upon manipulation of the tubing string, wherein the improvement further comprises means for releasably securing the friction element in a retracted position away from engagement with the casing and for releasing the friction element to engage the casing prior to resetting of the slip assembly.

5. In the tool as set forth in claim 4, wherein the improvement further comprises means for releasing the friction element as an incident to said first setting of the slip assembly.

6. In the tool as set forth in claim 5 with a tubular mandrel supporting the slip assembly and the reaction member thereon wherein the improvement further comprises supporting said adapter in telescoping relationship with said mandrel, a first shoulder on one of said adapter and said reaction member and a second shoulder on the other of said adapter and the reaction member, said first and second shoulders being in abutting relation with each other for shifting said slip assembly from said alternate transport condition into said setting condition by movement of said the reaction member.

7. In the tool as set forth in claim 6 wherein said means for releasably supporting the slip assembly in said alternate transport condition comprises a first frangible pin extending between said slip assembly and said mandrel, and said means for releasing the friction element comprises a second frangible pin extending between said reaction member and said mandrel.

8. In the tool as set forth in claim 7 wherein said resilient means includes a sealing unit mounted on said mandrel and coacting with said slip assembly when set to seal against the well casing, the improvement further comprising said means releasably supporting said slip in said alternate transport condition including frangible connecting means between said sealing unit and said mandrel for supporting said unit in an initial travel position on said mandrel, said connecting means being broken as an incident to said first setting of the slip assembly.

9. In the tool as set forth in claim 8, wherein after said first setting said sealing unit assumes a subsequent travel position relative to said mandrel upon unsetting said slip assembly by manipulation of said tubing string.

10. In the tool as set forth in claim 8, with the slip assembly including a pair of slip elements for supporting said sealing unit in sealing engagement with the well casing, wherein the improvement further comprises a shear screw securing one of said pair of slip elements initially in a travel position relative to said sealing unit, said shear screw being broken as an incident to said first setting of the slip assembly to release said one of said pair of elements for movement into a setting position embedding in the well casing.

11. A tool for use within the casing of a well including:

a tubular mandrel;

bi-directional slip assembly supported on said mandrel, said mandrel being manipulatable through setting and release sequences to shift relative to said slip assembly causing said assembly to move between extended and retracted positions to grip and release the well casing, respectively, at a downhole location in the well;

spring compression assembly on said mandrel movable between generally relaxed and compressed conditions for urging said slip assembly into said extended position when in said generally compressed condition;

slip disengaging means for retracting said slip assembly from said extended position to said retracted position during said release sequence;

setting stop means connected to said mandrel for engagement with said slip assembly to limit relative movement between said mandrel and said assembly at least initially in said setting sequence;

a reaction member carried on said mandrel and connectable with the well casing for support therefrom enabling relative movement between said member and said mandrel during said sequences;

connecting means between said reaction member and said mandrel for supporting said reaction member selectively on said mandrel in transport and setting conditions;

an adapter with one end frangibly connectable to a wireline setting device and an opposite end connecting at least indirectly to said slip assembly for a first setting of said slip assembly with the wireline setting device; and said slip assembly being supported temporarily in an alternate transport condition relative to said mandrel when first lowering the tool in the well prior to actuation of said wireline setting device.

12. In combination, a wireline setting device with one end connectable to a tubing string for use in a well and a shear stud connector at the other end thereof; and a well tool connected to said wireline setting device; said well tool including:

a tubular mandrel;

bi-directional slip assembly supported on said mandrel, said mandrel being manipulatable through setting and release sequences to shift relative to said slip assembly causing said assembly to move between extended and retracted positions to grip and release the well casing, respectively, at a downhole location in the well;

a spring compression assembly on said mandrel movable between generally relaxed and compressed conditions for urging said slip assembly into said extended position when in said generally compressed condition;

slip disengaging means for shifting said slip assembly from said extended position to said retracted position during said release sequence;

setting stop means connected to said mandrel for engagement with said slip assembly to limit relative movement between said mandrel, and said assembly at least initially in said setting sequence;

a reaction member secured to said slip assembly and carried on said mandrel, said reaction member being connectable with the well casing for support therefrom enabling relative movement between said member and said mandrel during said sequences;

connecting means between said reaction member and said mandrel for supporting said reaction member selectively on said mandrel in transport and setting conditions; and an adapter with one end connected to said shear stud connector and an opposite end connecting at least indirectly to said slip assembly for a first setting of said slip assembly by actuation of the wireline setting device and shearing of said stud, and said reaction member being supported temporarily in an alternate transport condition relative to said mandrel when first lowering the tool in the well prior to actuation of said wireline setting device.

13. A well tool for use in sealing against the casing at a selected position in a well to isolate the zone of the well above said selected position from the zone below said selected position, said tool including a tubular mandrel, a bi-directional slip assembly supported on said mandrel for anchoring the tool against the well casing in said selected position, a spring compression assembly on said mandrel movable between generally relaxed and compressed conditions for urging said slip assembly into said extended position when in said generally compressed condition, said spring compression assembly including a sealing unit mounted on said mandrel and coacting with said slip asembly to be compressed thereby for sealing against the well casing when said slip assembly is anchored against the well casing, locator means connecting between said slip assembly and said mandrel for supporting said slip assembly on said mandrel, a plug telescoped into said mandrel and having one end frangibly connectable to a wireline setting device and an opposite end connected to said locator means for supporting said slip assembly on said mandrel in a wireline transport condition preparatory to wireline setting of said slip assembly and thereafter selectively in either a release or a tubing transport condition, setting stop means connected to said mandrel for engagement with said slip assembly to limit relative movement between said mandrel and said slip assembly at least initially in said setting sequence, a reaction member carried on said mandrel and connected between said slip assembly and said locator means for engagement with the well casing to enable relative movement between said slip assembly and said mandrel for tubing string release and tubing string resetting of said slip assembly, and slip disengaging means for retracting said slip assembly from said extended position to said retracted position during said tubing string release.

14. A well tool as defined by claim 13 including a first shoulder on one of said plug opposite end and said locator and a second shoulder on the other of said plug opposite end and said locator, said shoulders being in abutting relationship with each other for shifing said slip assembly through said reaction member from said wireline transport condition into said setting condition.

15. In a method for setting, unsetting and resetting a tool against the casing in a well by manipulation of a tubing string, the improvement comprising the steps of first setting the slip assembly downhole in the well using a wireline setting device and, thereafter, connecting the tubing string to the tool as set downhole in the well for subsequent unsetting and resetting of the slip assembly by manipulation of the tubing string and without necessarily pulling the tubing string and tool from the well.

16. In a method for setting, unsetting and resetting the slip assembly of a tool against the casing in a well by manipulation of a tubing string, the improvement comprising the steps of attaching a wireline setting device to the tool, lowering the tool by wireline into the well to a selected position, actuating the wireline setting device for a first setting of the slip assembly in the well, detaching the wireline from the tool while leaving the slip assembly set, retrieving the wireline from the well, thereafter connecting a tubing string to the tool for manipulation of the tubing string for subsequent unsetting and resetting of the slip assembly without the necessity of pulling the tool from the well for redressing prior to being reset.

17. The method as set forth in claim 16 wherein said tool includes locator means supporting a reaction member and connecting with the slip assembly on a mandrel for shifting the latter between transport and setting conditions relative to the slip assembly, said method including the additional steps of releasably supporting said reaction member in an alternate condition for lowering of the tool by wireline into the well, releasing the reaction member from said alternate transport condition and shifting of the reaction member from said alternate transport condition into its setting condition as an incident to said first setting of the slip assembly.

18. The method as set forth in claim 17 wherein the reaction member of the tool includes a friction element engageable with the well casing whereby reaction forces may be transmitted between the tool and the tubing string during manipulation thereof for shifting of the reaction member between its transport and setting conditions, said method including the additional steps of releasably securing the friction element in a retracted position away from engagement with said casing prior to said first setting of the slip assembly, and releasing the friction element to engage the casing prior to resetting of the slip assembly.

19. The method as set forth in claim 18 wherein said step of releasing the friction element occurs as an incident to said first setting of the slip assembly.

20. The method as set forth in claim 17 wherein said tool includes a sealing unit mounted on said mandrel for sealing against the casing in the well when the slip assembly is set, said method including the additional steps of releasably supporting the sealing unit in an initial travel position for lowering of the tool by wireline into the well, freeing the sealing unit to coact with the slip assembly to seal against the casing during said first setting of the slip assembly, repositioning the sealing unit in a subsequent travel position during subsequent unsetting of the slip assembly by manipulation of the tubing string.

21. The method as set forth in claim 20 wherein the slip assembly of the tool includes a pair of slip elements for supporting the sealing unit in sealing engagement with the well casing, said method including the additional steps of releasably connecting one of said pair of slip elements in an initial travel position relative to the sealing unit, disconnecting said one of said slip elements when first setting the slip assembly, and repositioning the one slip element in a subsequent travel position relative to said sealing unit when unsetting the slip assembly by manipulation of the tubing string.

* * * * *